US009616267B2

(12) United States Patent
Sassano

(10) Patent No.: US 9,616,267 B2
(45) Date of Patent: Apr. 11, 2017

(54) BACK STRENGTHENING AND THERAPY DEVICE

(71) Applicant: Luciano Sassano, Sewell, NJ (US)

(72) Inventor: Luciano Sassano, Sewell, NJ (US)

( * ) Notice: Subject to any disclaimer, the term of this patent is extended or adjusted under 35 U.S.C. 154(b) by 102 days.

(21) Appl. No.: 14/642,930

(22) Filed: Mar. 10, 2015

(65) Prior Publication Data

US 2016/0263419 A1 Sep. 15, 2016

(51) Int. Cl.
*A63B 21/02* (2006.01)
*A61H 15/00* (2006.01)
(Continued)

(52) U.S. Cl.
CPC ..... *A63B 21/02* (2013.01); *A61H 1/0292* (2013.01); *A63B 21/00043* (2013.01);
(Continued)

(58) Field of Classification Search
CPC ..... A63B 21/00; A63B 21/0004; A63B 21/00043; A63B 21/00178; A63B 21/00185; A63B 21/02; A63B 21/021; A63B 21/022; A63B 21/023; A63B 21/025; A63B 21/026; A63B 21/027; A63B 21/028; A63B 21/04; A63B 21/0407; A63B 21/0428; A63B 21/0435; A63B 21/055; A63B 21/0552; A63B 21/0557; A63B 21/159; A63B 21/4007; A63B 21/4025; A63B 21/4033; A63B 21/4035; A63B 21/4039; A63B 21/4041; A63B 21/4047; A63B 2022/0035; A63B 2022/0094; A63B 23/0233; A63B 23/0238; A63B 23/0355; A63B 23/1254; A63B 23/18; A63B 2023/006; A63B 2208/0204; A61H 1/006; A61H 1/0292; A61H 2201/0157; A61H 2201/1623; A61H 2201/1626; A61H 2201/1645; A61H 2201/1647; A61H 2201/165; A61H 2201/1676; A61H 2201/1685; A61H 7/00; A61H 7/002; A61H 7/003; A61H 15/00; A61H 15/0092; A61H 23/06; A61H 2203/0406
See application file for complete search history.

(56) References Cited

U.S. PATENT DOCUMENTS 3,503,388 A * 3/1970 Cook ..... A61H 31/00 482/13
4,411,421 A * 10/1983 Hershberger ..... A61H 15/00 482/132
(Continued)

*Primary Examiner* — Joshua Lee
(74) *Attorney, Agent, or Firm* — Stuart M. Goldstein

(57) ABSTRACT

A back strengthening and therapy device has a frame with two body encircling frame members, each frame member having a front end and a rear end. A handle is located on the front end of each of the frame members and a back impacting element is located at the rear end of each frame member. An expandable, cross member interconnects the frame members. When this cross member is locked, the user can conveniently position the back impacting elements on his or her back and apply selected pressure to the back by manipulating the handles and the back impacting elements. When this cross member is unlocked, allowing the elastic to expand, the user can pull backward, creating resistance, in a repeated motion, for purposes of strengthening the back.

12 Claims, 3 Drawing Sheets

(51) Int. Cl.

| | |
|---|---|
| ***A61H 1/02*** | (2006.01) |
| ***A63B 21/00*** | (2006.01) |
| *A63B 21/04* | (2006.01) |
| *A61H 7/00* | (2006.01) |
| *A63B 23/02* | (2006.01) |

(52) U.S. Cl.

CPC ..... *A63B 21/4007* (2015.10); *A61H 7/00* (2013.01); *A61H 7/002* (2013.01); *A61H 7/003* (2013.01); *A61H 15/0092* (2013.01); *A61H 2201/1253* (2013.01); *A61H 2205/081* (2013.01); *A61H 2205/084* (2013.01); *A63B 21/0004* (2013.01); *A63B 21/00185* (2013.01); *A63B 21/0407* (2013.01); *A63B 21/0428* (2013.01); *A63B 21/0435* (2013.01); *A63B 21/4025* (2015.10); *A63B 21/4035* (2015.10); *A63B 21/4047* (2015.10); *A63B 23/0233* (2013.01); *A63B 23/0238* (2013.01)

(56) References Cited

U.S. PATENT DOCUMENTS 4,493,315 A * 1/1985 Iwahashi ..... A61H 7/001 601/135
5,005,832 A * 4/1991 Van Der Hoeven ..... A63B 21/4025 482/124
5,560,604 A * 10/1996 Watts ..... A63B 69/0084 473/147
5,690,494 A * 11/1997 Luker ..... A63B 21/0004 434/252
5,730,708 A * 3/1998 Spratt ..... A61H 7/003 601/118
5,741,207 A * 4/1998 Buoni ..... A63B 21/0004 482/122
5,769,764 A * 6/1998 Tilberis ..... A63B 23/03575 482/124
5,848,980 A * 12/1998 Demerais ..... A61H 23/02 601/133
6,026,531 A * 2/2000 Pruitt ..... A47K 7/022 15/160
6,241,693 B1 * 6/2001 Lambden ..... A61H 7/001 601/119
6,244,994 B1 * 6/2001 Tilberis ..... A63B 21/0023 482/124
6,332,873 B1 * 12/2001 Naruse ..... A61H 23/0263 601/134
6,368,257 B1 * 4/2002 Kaplan ..... A63B 23/03541 482/112
7,086,992 B2 * 8/2006 Bowman ..... A63B 23/0222 482/142
7,125,390 B2 * 10/2006 Ferber ..... A61H 23/0263 601/101
7,291,101 B2 * 11/2007 Deal ..... A61H 15/0092 482/121
8,337,438 B2 * 12/2012 Schupman ..... A61H 7/001 601/135
8,419,663 B2 * 4/2013 Eitzen ..... A61H 7/003 601/136
D685,107 S * 6/2013 Oller, Jr. ..... D24/215
2002/0091048 A1 * 7/2002 Chen ..... A63B 21/0004 482/126
2003/0236155 A1 * 12/2003 Yang ..... A63B 21/0004 482/140
2004/0249325 A1 * 12/2004 Stultz ..... A61H 7/003 601/135
2012/0259257 A1 * 10/2012 Nelson ..... A61H 15/0092 601/119

* cited by examiner

BACK STRENGTHENING AND THERAPY DEVICE

FIELD OF THE INVENTION

The present invention relates to a manual exercise device for strengthening the muscles in the back, as well as applying therapeutic pressure to the spine to improve alignment and reduce pain and discomfort associated with tightness/stiffness in the back.

BACKGROUND OF THE INVENTION

Studies show that approximately 80% of all adults will experience some type of low back pain during their lives. As many as 50% of working Americans are effected with back problems each year. Treatment for back pain is one of the most expensive medical problems in America. The total cost attributed to the treatment of back disorders is at least fifty billion dollars per year.

It has been shown that the most effective means of back injury and back pain prevention is a regular course of exercise. While there are numerous back exercising machines and fitness centers with physical therapists and fitness experts, these alternatives are generally expense prohibited to the average individual suffering from back pain. Even these back exercising means are often inadequate to treat back problems. They especially fail to address the strengthening of back muscles in order to avoid such problems.

SUMMARY OF THE INVENTION

It is thus the object of the present invention to provide a back strengthening and therapy device which can easily and effectively be used by individuals of all ages, sexes, and physiques.

It is the object of the present invention to provide a back strengthening and therapy device which allows for hand-held manipulation, in order to set the device at various positions, thus addressing a multitude of muscles and vertebrae in the back.

It is another object of the present invention to provide a back strengthening and therapy device which relieves specific and targeted pain and tightness in the back.

It is a further object of the present invention to provide a back strengthening and therapy device which assists in strengthening back muscles in order to rehabilitate and align the back.

It is still another object of the present invention to provide a back strengthening and therapy device which applies pressure to back muscles to assist in spinal manipulation/alignment and as an effective spine pain treatment for reducing pain, decreasing the need for medication, and rapidly advancing physical therapy treatment.

It is a further object of the present invention to provide a back strengthening and therapy device which is not only effective, but also lightweight, adjustable, easy to use, and relatively inexpensive to manufacture and thus readily affordable.

These and other objects are accomplished by the present invention, a back strengthening and therapy device having a frame with two body encircling frame members, each frame member having a front end and a rear end. A handle is located on the front end of each of the frame members and a back impacting element is located at the rear end of each frame member. An expandable, cross member interconnects the frame members. The user can conveniently position the back impacting elements on his or her back and apply selected pressure to the back by manipulating the handles and the back impacting elements. Alternatively, the user can position the device across the chest, and pull back on both handles in a repeated motion, where the resistance created will facilitate back muscle strengthening.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
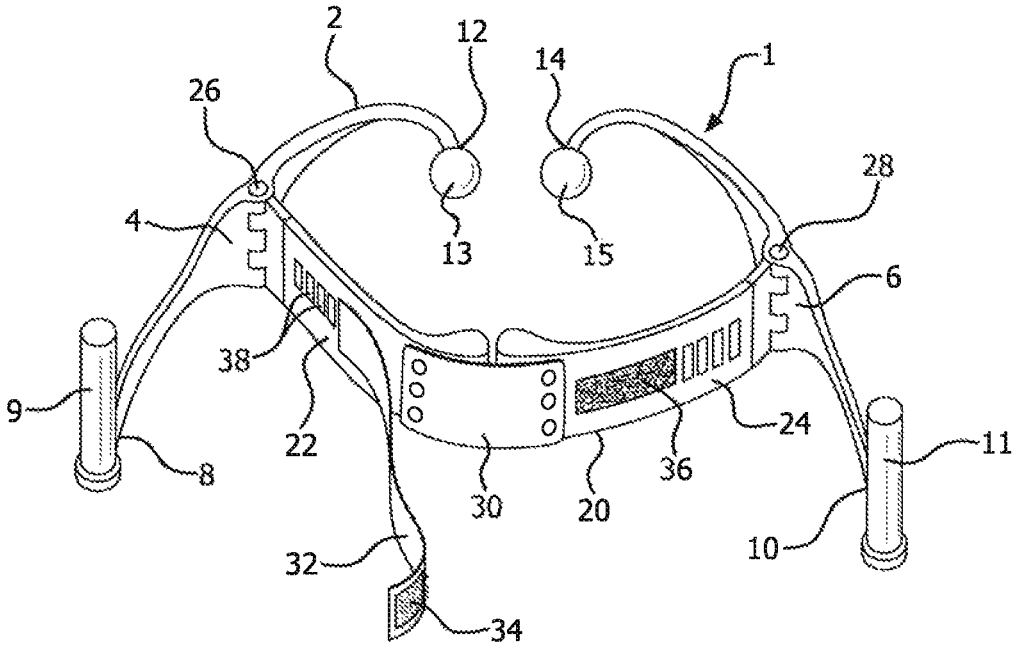
FIG. 1 is a front isometric view of the back strengthening and therapy device of the present invention.

Back strengthening and therapy device 1 of the present invention comprises body encircling frame 2 having two body encircling frame members 4 and 6. Handles 9 and 11 are located at front ends 8 and 10 of frame members 4 and 6 and back impacting elements 13 and 15 are located at the rear ends 12 and 14 of the frame members.

Cross member 20 interconnects frame members 4 and 6. Cross member 20 comprises cross member sections 22 and 24 which are connected to frame members 4 and 6 via pins 26 and 28, allowing the frame members to be rotatable in relation to the cross member and more specifically to the cross member sections. Elastic band element 30 is attached to cross member sections 22 and 24, which permits the length of cross member 20 to expand and contract when handles 9 and 11 are pulled back, when using the device for strengthening the back. Strap 32 is adjustably connected at one of its ends to cross member section 22. Velcro® or like hook and eye connector 34 is located at the other end of strap 32 and secures the strap to cross member 24 having corresponding Velcro®/hook and eye connector 36. Securing strap 32 in this manner serves to restrict any expansion of the elastic band element when using the device to manipulate and align the back using the pressure elements. Multiple sizing slots 38 are provided for attachment to strap 32, to accommodate chests of different widths, allowing for use by individuals of all sizes.

Back strengthening and therapy device 1 is utilized in two ways: For back strengthening, user 40 simply positions cross member 20 (with Velcro® "unsecured or unlocked") around the chest of the user with frame members 4 and 6 positioned laterally, such that the user grips and pulls back on handles 9 and 11 in a straight back motion. This action results in cross member sections 22 and 24, positioned across the chest of the user, to separate, but remain connected by means of elastic band 30. The rib cage of the user is thereby caused to expand, immediately providing a degree of correction and relief to stiff vertebra. Repeating this action of pulling back on handles 9 and 11 directly works to strengthen back muscles.

Figure 4:
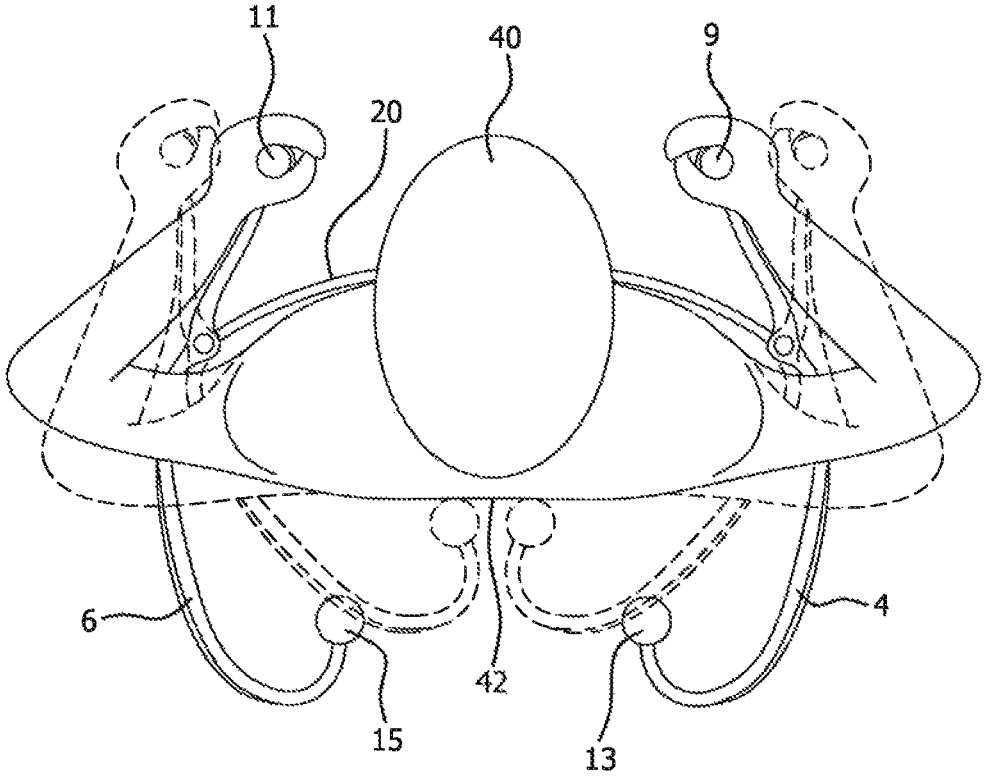
FIG. 4 is a top view illustrating the use of the back strengthening and therapy device of the present invention.

For back therapy/alignment, user 40 can also choose to "lock" front cross member 20 by attaching the Velcro® or like connector 34 to the corresponding connector 36. Once locked, pulling back and out on handles 9 and 11 forces back impacting elements 13 and 15 to press against back 42 at both sides of the spine simultaneously, as best seen in FIG. 4. The more force the user applies in pulling back on handles 9 and 11, the more pressure is applied. Thus, the user is able, without outside assistance, to symmetrically manipulate and/or massage the back with the exact amount of pressure that only that individual can gage to be correct.

Figure 2:
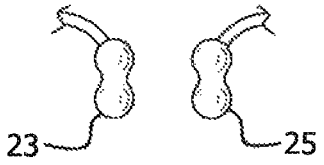
FIG. 2 shows alternate back impacting elements.
Figure 3:
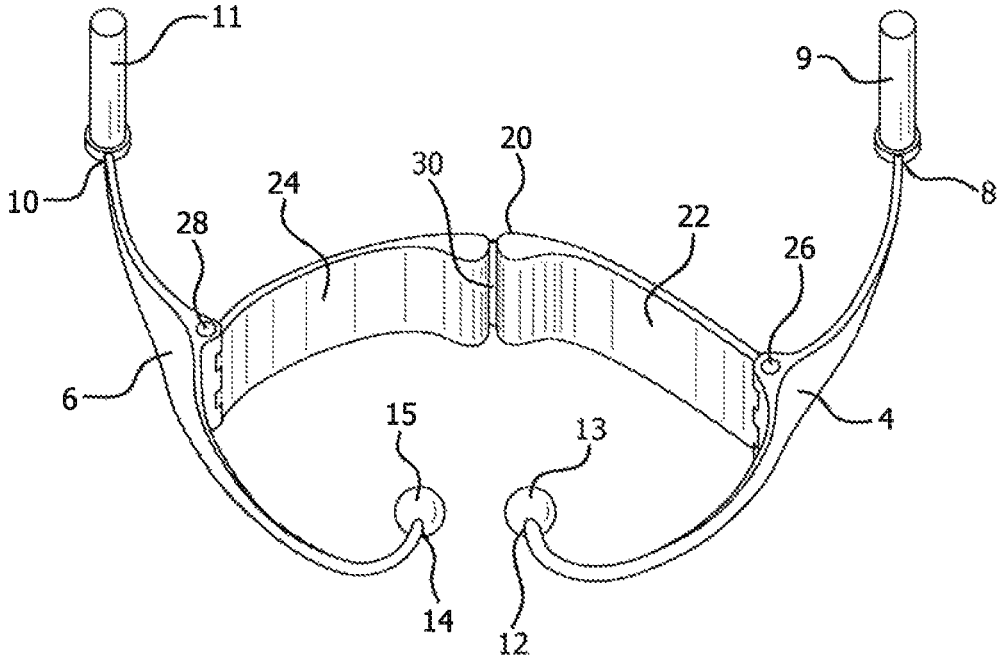
FIG. 3 is a rear isometric view of the hack strengthening and therapy device of the present invention.

Back impacting elements 13 and 15 are interchangeable with alternate elements 23 and 25, such as are shown in FIG. 2. This allows the user to choose different pressure/massage options, since having pressure tips of multiple sizes and shapes allows for varying forms of pressure to be directed at the vertebra. While certain back impacting elements are disclosed herein, the shape and size of the elements should not be considered restricted to those disclosed. Other back impacting elements of alternate configurations can be used as well. Further, the back impacting elements described herein may be completely removed to focus more on back strengthening.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A manually operable back strengthening and therapy device configured to encircle the back and chest of a user, the device comprising:

a body encircling frame having a front end and a rear end;

a chest positioned cross member rotatably connected to the frame at two connection sites, each connection site being located between and in spaced relation to both the front and rear end of the frame, whereby the cross member is configured to extend across the chest of the user and the frame is configured to extend around the back of the user;

two handles located on the front end of the frame; and two back impacting elements located at the rear end of the frame, whereby positions of and pressures exerted by the back impacting elements on the back of the user are adjustable by movement of the handles.

2. The back strengthening and therapy device as in claim 1 wherein the cross member is adjustably expandable to different lengths.

3. The back strengthening and therapy device as in claim 1 wherein the cross member is rotatably connected to the frame by pins.

4. The back strengthening and therapy device as in claim 2 wherein the cross member is rotatably connected to the frame by pins.

5. The back strengthening and therapy device as in claim 1 wherein the cross member comprises two cross member sections and an elastic element interconnecting the two cross member sections, each cross member section being rotatably connected to the frame, the cross member sections and elastic element are configured to extend across the chest of the user.

6. The back strengthening and therapy device as in claim 1 wherein the back impacting elements are removable and replaceable with back impacting elements having alternate configurations.

7. A manually operable back strengthening and therapy device configured to encircle the back and chest of a user, the device comprising:

two body encircling frame members, each frame member having a front end and a rear end;

a handle on the front end of each frame member and a back impacting element at the rear end of each frame member, whereby positions of and pressures exerted by the back impacting elements on the back of the user are adjustable by movement of the handles; and a chest positioned cross member rotatably connected to the two frame members at two connection sites, each connection site being located between and in spaced relation to both the front ends and rear ends of the frame members, whereby the cross member is configured to extend across the chest of the user and the frame members are configured to extend around the back of the user.

8. The back strengthening and therapy device as in claim 7 wherein the cross member is adjustably expandable to different lengths.

9. The back strengthening and therapy device as in claim 7 wherein the cross member is rotatably connected to the two frame members by pins.

10. The back strengthening and therapy device as in claim 8 wherein the cross member is rotatably connected to the two frame members by pins.

11. The back strengthening and therapy device as in claim 7 wherein the cross member comprises two cross member sections and an elastic element interconnecting the two cross member sections, one cross member section being rotatably connected to one of the frame members and the other cross member section being rotatably connected to the other frame member, the cross member sections and elastic element are configured to extend across the chest of the user.

12. The back strengthening and therapy device as in claim 7 wherein the back impact elements are removable and replaceable with back impacting elements having alternate configurations.

* * * * *